United States Patent [19]

Carter et al.

[11] 3,933,004

[45] Jan. 20, 1076

[54] REFRIGERATION CONTROL SYSTEMS

[75] Inventors: William Derrick Marshall Carter, Holme Drove; Gerald Robin Scrine, Cambridge, both of England

[73] Assignee: Shipowners Refrigerated Cargo Research Association, London, England

[22] Filed: Apr. 25, 1974

[21] Appl. No.: 463,964

[30] Foreign Application Priority Data

Apr. 26, 1973 United Kingdom ..... 19935/73

[52] U.S. Cl. ..... 62/199; 62/196; 237/2 B

[51] Int. Cl.[2] ..... F24D 11/02; F25B 13/00

[58] Field of Search ..... 62/196, 199, 200, 278, 62/525; 237/2 B

[56] References Cited

UNITED STATES PATENTS

| | | | |
|---|---|---|---|
| 2,252,300 | 8/1941 | McGrath | 62/196 |
| 2,283,386 | 5/1942 | Newton | 236/1 E UX |
| 2,328,472 | 8/1943 | Lehane et al. | 236/1 E UX |
| 2,344,215 | 3/1944 | Soling | 62/196 |
| 2,614,394 | 10/1952 | McGrath | 62/199 |
| 2,679,142 | 5/1954 | McGrath | 62/173 |
| 2,707,868 | 5/1955 | Goodman | 62/196 |
| 3,791,160 | 2/1974 | Savitz | 62/196 |

*Primary Examiner*—William E. Wayner
*Attorney, Agent, or Firm*—Baldwin, Wight & Brown

[57] ABSTRACT

In a refrigeration system for a substantially enclosed space and including a compressor, a condenser, an evaporator, conduit means connecting the said compressor, condenser and evaporator to form a cooling circuit, and a hot gas by-pass conduit between the compressor and the evaporator, the improvement which comprises means provided in the system for apportioning flow of gas between the cooling circuit and the by-pass conduit so that, during a temperature controlling phase of refrigeration, the gas flows both to the condenser and to the by-pass conduit and the apportioning of flow can cause either net heating or net cooling of the enclosed space.

15 Claims, 3 Drawing Figures

REFRIGERATION CONTROL SYSTEMS

Figure 1:
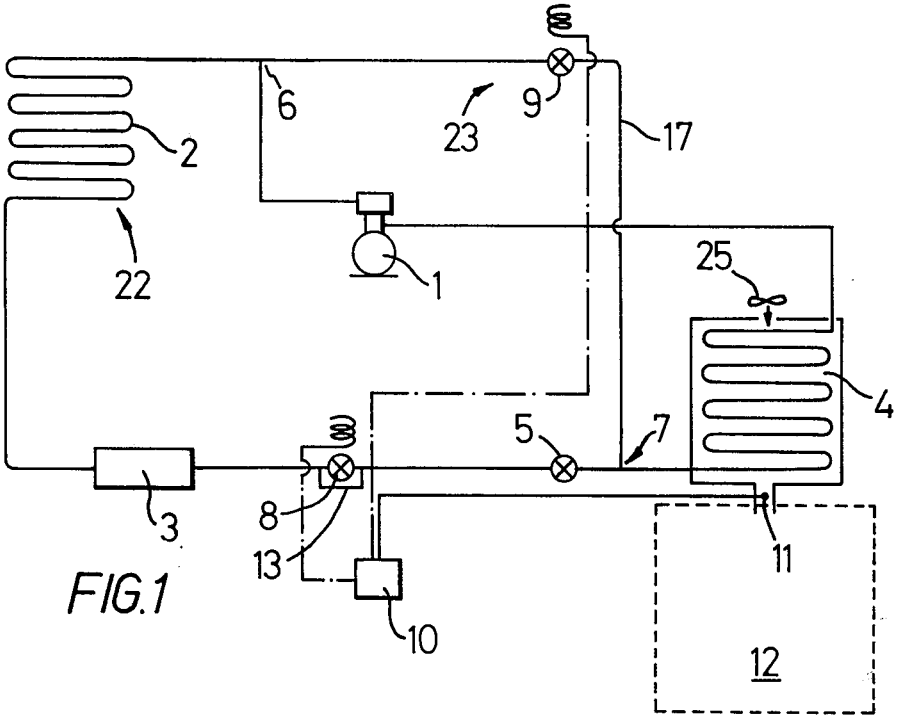

This invention relates to refrigeration systems and especially to refrigeration systems for controlling the temperature of an enclosed space such as the cargo space of a container or a long-distance transport vehicle.

It is frequently essential that perishable cargo which is to be moved over long distances is maintained at a more or less constant temperature. This is normally done by means of a refrigeration system with a compressor, a condenser and an evaporator. In the simplest control systems, a thermostat operated by a thermometer bulb in the enclosed space simply cuts off the compressor when the temperature has reached a desired low level and switches it on again when an upper limit has been reached.

However, this system does not in practice result in a sufficient degree of control because of the thermostat differential which is necessary to prevent rapid recycling of the compressor unit. Furthermore, in the case of ships which may have to pass through polar regions, when the ambient temperature is lower than the desired temperature in the enclosed space, a certain degree of heating is required.

These problems have been partially overcome in two ways. Some refrigeration systems allow for a complete flow reversal of the refrigerant so that the hot compressed gas flows to the evaporator coil of the system, thus effecting heating of the enclosed space. It is also known to introduce a by-pass conduit into the conventional system, this by-pass leading directly from the compressor to the evaporator, thus by-passing the condenser. This by-pass allows a heating effect on the space by leading hot gas to the evaporator directly. Also with such a by-pass system, it is known to direct some refrigerant gas to the by-pass as the temperature falls, thus reducing the rate of cooling as the temperature nears the lower limit. This tends to reduce the overshoot of temperature to the low side.

The present invention provides improvements for such refrigeration control systems, especially for a system including a hot gas by-pass.

According to the invention, in a refrigeration system for a substantially enclosed space and including a compressor, a condenser and an evaporator and having a hot gas by-pass conduit between the compressor and the evaporator, we provide means for apportioning the flow of compressed refrigerant gas between the condenser and the by-pass conduit so that, during a temperature controlling phase of refrigeration, the gas flows both to the condenser and to the by-pass conduit and the apportioning of flow can cause either net heating or net cooling of the enclosed space.

Preferably, a first solenoid valve is provided in the by-pass conduit and a second solenoid valve with an open by-pass is provided in the condenser circuit; during the controlling phase, when both valves are open, the apportioning means provides for a net cooling of the space and when the second solenoid valve is closed, and there is net heating of the space, the open by-pass allows a proportion of condensed refrigerant to flow, thus counteracting the heating effect.

The means for apportioning flow may be a throttling valve, and thermostatic means responsive to the ambient temperature may be provided for controlling the valve, so that as the ambient temperature falls, the flow of gas along the by-pass conduit increases relative to the flow in the main circuit.

Alternatively, the means for apportioning flow may comprise a pipeline in the system which is divided over at least part of its length into a plurality of pipes in parallel, each pipe having a valve and each valve being controlled by a multi-stage thermostat responsive to the heating or cooling requirement of the space so that, depending on the temperature of the thermostat sensor, one or more of the pipes may be closed. The pipeline may be part of the hot gas by-pass conduit or may form part of a conduit leading to the evaporator of the system.

In a preferred refrigeration system, in which a flow of air is passed over a refrigerant evaporator and into a substantially enclosed refrigerated space, a thermostatic control for the refrigeration system may be provided in which the thermostat sensor is located in the air flow entering the refrigerated space.

Figure 2:
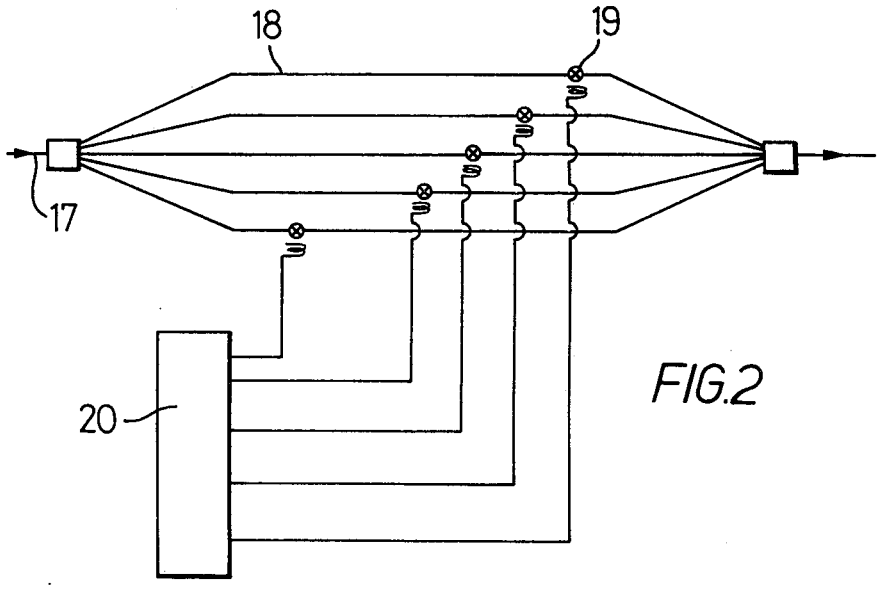
Figure 3:
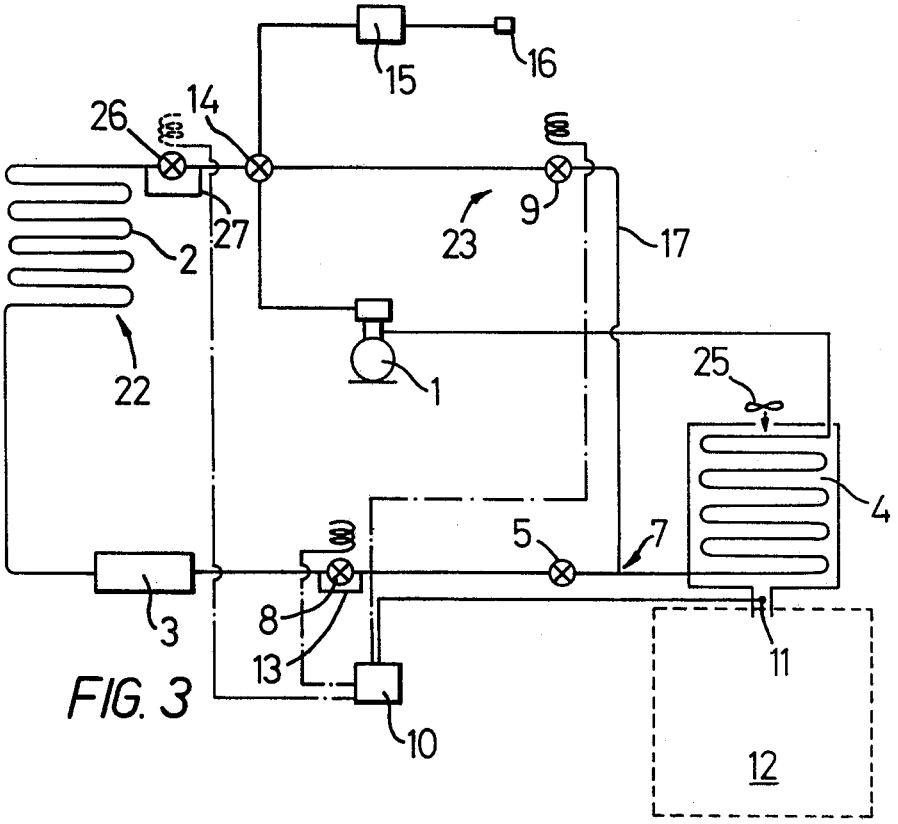

Preferred embodiments of the invention are now described with reference to the accompanying diagrammatic drawing, in which FIG. 1 is a schematic of a refrigeration control system, FIG. 2 shows means for controlling flow of fluid along a conduit of a refrigeration system, and FIG. 3 is a schematic of a modification of the refrigeration system of FIG. 1.

Referring to the drawing, FIG. 1 shows a refrigeration system including a conventional refrigerator circuit 22 and a hot gas by-pass circuit 23. The conventional or main circuit 22 includes a compressor 1, a condenser 2, a liquid receiver 3 and an evaporator 4. For normal cooling, the refrigerant passes from the compressor 1 to the condenser 2 where it is liquefied and then through the liquid receiver 3 to an expansion valve 5 (normally a thermostatic valve with a bulb and capillary) before entering the evaporator.

The by-pass circuit 23 leaves the main circuit at a T-piece 6, includes a by-pass conduit 17, and rejoins the main circuit at point 7 near the inlet to the evaporator 4. A solenoid valve 8 is provided in the main circuit and a second solenoid valve 9 is provided in the hot gas by-pass conduit 17. The solenoid valves 8 and 9 are controlled by a thermostat 10, whose sensor is a thermometer bulb 11. The electrical connection between the thermostat and the valves are shown in dash-dot lines.

The bulb 11 is situated at a point where air or, if necessary, nitrogen is passed into a refrigerated space 1 having been cooled by its passage over the evaporator 4. A fan 25 is provided to force the air over the evaporator. It has been found that locating the bulb at this point allows the optimum control of the temperature of the gas throughout the space 12. Especially during the controlling phase of refrigeration, where the temperature is fluctuating around its set point, this location for the bulb gives the finest possible control.

The solenoid valve 9 can be completely closed in order to shut off the hot gas by-pass conduit 17 for maximum cooling. Thus, during the initial cooling of the space, the valve 9 will be closed and the system acts in a completely conventional way to cool the space 12. Once the space 12 has been cooled to near its desired temperature, the controlling phase of the refrigeration is established.

In the embodiment of FIG. 1, the T-piece 6 is a simple T-piece dividing the flow between the main and by-pass conduits 22 and 23 and the flow from the compressor is so arranged that, with both valves 8 and 9 open, there is flow along both circuits. After the initial cooling phase, the valve 9 is opened and the rate of codling decreases as the temperature nears its set point.

When it is necessary to provide net heating for the space 12, the valve 8 is closed. This valve, however, is provided with an open by-pass duct 13 which always allows a small flow of refrigerant to the evaporator, thus avoiding overheating of the space. Overheating does not take place as the system returns to refrigeration once the temperature rises to its upper limit. The by-pass 13 reduces the rate at which the temperature rises but does not prevent it rising above the preset upper limit.

During the controlling phase of refrigeration, therefore, the system may alternate between net cooling (with most flow through the condenser) and net heating (with most flow through the by-pass conduit 17).

The system described above can, with advantage in some cases, be modified as shown in FIG. 3, by including a solenoid valve 26 in the cooling circuit upstream of the condenser. The valve 26, like the valve 8, is provided with a by-pass duct 27 so that there is never a complete stoppage of flow round the cooling circuit. The solenoid valve 26 is also operated by the controller 10.

The refrigeration system equipped with the valve 26 can be operated in the following way to give improved control over the temperature of the space 12. During the controlling phase of refrigeration, when the refrigerated container is passing through an area where the ambient temperature is very low, the valve 9 will be open and the valve 8 will be shut. There will thus be net heating of the space 12. In the absence of valve 26, then it may be that the net heating is insufficient to maintain the desired temperature. However, where the valve 26 is included, this may also be closed, in which case the flow of refrigerant gas to the condenser is markedly reduced and the heating effect is thereby increased.

It may also be convenient in certain cases to reduce the flow in the cooling circuit by alternately and simultaneously opening and closing the valves 8 and 26, only one being open at a time. This has the effect of reducing the cooling flow to the space while avoiding undue liquid accumulation in the receiver 3 and the condenser.

The valve 26, instead of being in the pipe leading to the condenser as show, may be incorporated into the T-piece 6, being so arranged in this case that the pipe leading to the condenser is never completely closed.

In the embodiment of FIG. 3 the T-piece 6 is replaced by a throttling valve 14 which can apportion a varying flow of gas between the condenser 2 and the by-pass conduit 17. The setting of this valve is operated by a controller 15 actuated by a sensor 16 which is located outside the space 12 and which reads the ambient temperature. Thus, when the ambient temperature is relatively high during the controlling phase of refrigeration, the space temperature can be accurately maintained when most gas is passing through the condenser 2. However, when the ambient temperature is low, the space temperature can be best maintained when most gas is passing through the by-pass conduit 17. Thus, the ambient control of the valve 14 ensures the optimun apportioning of flow between the two circuits.

A further method of controlling flow along a conduit is show in FIG. 2. A conduit 17 is split into a plurality of, e.g. five, parallel pipes 18 which rejoin to reform the conduit. Each pipe 18 has a valve 19 operated by a controller 20 responsive to temperature change in the space 12. Thus, the thermostat can operate successively to close off the valves 19 and thus gradually reduce flow along the conduit. The valves 19 may all be indentical and the thermostatic controller 20 may be arranged so as to open and close the valves sequentially. Thus, in a fine control situation, two valves may be open and a third be opening and closing in response to stimulus from the controller 20.

Alternatively, each valve 19 may be of a different size and the controller may select the single valve which is most appropriate to the heating or cooling requirement of the heating space. Control in this case would be by switching from one valve to another.

Where the valves are of unequal size, the controller may also select any combination of valves which provides the correct apportioning of refrigerant flow and, again, fine control may be by the opening and closing of a single valve.

This type of flow control can, for example, replace the solenoid valve 9 in the system of FIG. 1. This would then allow a varying proportion of hot has to pass through the by-pass conduit, so as to provide either a net heating or net cooling of the system.

Alternatively, the flow control may replace the solenoid valve 8, in which case the hot gas by-pass may be left open, the liquid to the evaporator being apportioned by the flow control device.

What is claimed is:

1. In a refrigeration system for a substantially enclosed space and including a compressor, a condenser, an evaporator, conduit means connecting said compressor, condenser and evaporator to form a cooling circuit, a hot gas by-pass conduit between the compressor and the evaporator and a thermostat which is sensitive to the heating or cooling requirement of the space, the improvement which comprises a first valve responsive to said thermostat provided in the hot gas by-pass conduit, a second valve responsive to said thermostat provided in the cooling circuit, the second valve having a permanently open by-pass, and means provided in the system for apportioning flow of gas between the cooling circuit and the by-pass conduit so that, during a temperature controlling phase of refrigeration, the gas flows both to the condenser and to the by-pass conduit and the apportioning of flow can cause either net heating or net cooling of the enclosed space, and in which the means apportioning the flow is so arranged that when first and second valves are open, there is net cooling of the space and that when said second valve is closed, there is net heating of the space.

2. The refrigeration system of claim 1 in which a third valve controlled by the thermostat is provided in the cooling circuit upstream of the condenser, said third valve having a permanently open by-pass.

3. The refrigeration system of claim 2 in which said first, second and third valves are solenoid valves.

4. The refrigeration system of claim 1 in which the means for apportioning flow is a throttling valve having means for variably apportioning gas between the cooling circuit and the hot gas by-pass conduit.

5. The refrigeration system of claim 4 in which the throttling valve is controlled by means responsive to ambient temperature so that as the ambient temperature falls the flow of gas along the by-pass conduit increases relative to the flow of gas in the cooling circuit.

6. The refrigeration system of claim 1 in which one of the cooling circuit and the hot gas by-pass conduit includes a valve and the other includes a pipe-line which is divided over at least part of its length into a plurality of pipes in parallel, each pipe having a valve and the valves being controlled by a multi-stage thermostat responsive to the heating or cooling requirement of the space so that one or more of the valves may be closed to apportion the flow of gas.

7. The refrigeration system of claim 6 in which the valves in the plurality of pipes are substantially identical to each other.

8. The refrigeration system of claim 6 in which each said pipe has a valve of a size different from those of the other said pipes.

9. The refrigeration system of claim 2 in which a flow of air is passed over the refrigerant evaporator and into said substantially enclosed space and in which a temperature sensor for the thermostatic control of the system is provided and is located in the air flow entering said space.

10. The refrigeration system of claim 1 in which a flow of air is passed over the refrigerant evaporator and into said substantially enclosed space and in which a temperature sensor for the thermostatic control of the system is provided and is located in the air flow entering said space.

11. The refrigeration system of claim 7 in which the said first and second valves are solenoid valves.

12. The refrigeration system of claim 11 in which a third solenoid valve controlled by the thermostat is provided in the cooling circuit upstream of the condenser, the said third valve having a permanently open by-pass.

13. The refrigeration system of claim 11 in which a flow of air is passed over the refrigerant evaporator and into the said substantially enclosed space and in which a temperature sensor for the thermostatic control of the system is provided and is located in the air flow entering the said space.

14. In a refrigeration system for a substantially enclosed space and including a compressor, a condenser, an evaporator, conduit means connecting the said compressor, condenser and evaporator to form a cooling circuit, and a hot gas by-pass conduit between the compressor and the evaporator, the improvement which comprises means provided in the system for apportioning flow of gas between the cooling circuit and the by-pass conduit so that, during a temperature controlling phase of refrigeration, the gas flows both to the condenser and to the by-pass conduit and the apportioning of flow can cause either net heating or net cooling of the enclosed space, the means for apportioning flow is a throttling valve having means for variably apportioning gas between the cooling circuit and the hot gas by-pass conduit, and the throttling valve being controlled by means responsive to ambient temperature so that, as to the ambient temperature falls, the flow of gas along the by-pass conduit increases relative to the flow of gas in the cooling circuit.

15. The refrigeration system of claim 14 in which a flow of air is passed over the refrigerant evaporator and into the said substantially enclosed space and in which a temperature sensor for the thermostatic control of the system is provided and is located in the air flow entering the said space.

* * * * *